United States Patent [19]

Prader

[11] Patent Number: 4,858,862

[45] Date of Patent: Aug. 22, 1989

[54] APPARATUS FOR SUSPENDING BAG PACKS OF DIFFERENT GEOMETRY

[75] Inventor: Randolph D. Prader, Fairport, N.Y.

[73] Assignee: Mobil Oil Corporation, New York, N.Y.

[21] Appl. No.: 810,454

[22] Filed: Dec. 18, 1985

[51] Int. Cl.[4] ..... B65B 67/04

[52] U.S. Cl. ..... 248/99; D6/566; 53/390

[58] Field of Search ..... 248/99, 100, 95, 97; D34/5, 6; 141/391; D6/553, 566; 53/390

[56] References Cited

U.S. PATENT DOCUMENTS

| | | | |
|---|---|---|---|
| D. 264,651 | 6/1982 | Adamson | D6/566 |
| D. 264,653 | 6/1982 | Adamson | D6/566 |
| D. 264,905 | 6/1982 | Adamson | D6/566 |
| D. 271,067 | 10/1983 | Prader | D6/566 |
| D. 273,159 | 3/1984 | Adamson et al. | D34/6 X |
| 4,062,170 | 12/1977 | Orem | 53/390 |
| 4,363,405 | 12/1982 | Christie | 248/100 X |
| 4,398,689 | 8/1983 | Prader | 248/99 |
| 4,407,474 | 10/1983 | Swenson | 248/97 |
| 4,458,867 | 7/1984 | Malik | 248/97 |
| 4,487,388 | 12/1984 | Provan | 248/99 X |

*Primary Examiner*—Ramon S. Britts
*Assistant Examiner*—David L. Talbott
*Attorney, Agent, or Firm*—Alexander J. McKillop; Charles J. Speciale; James P. O'Sullivan, Sr.

[57] ABSTRACT

An apparatus for the support of loop handled bag packs of different general geometry which is also adapted for the loading of individual bags from said bag packs, said apparatus including a support means for a bag of first general geometry and a second support means for a bag pack of general geometry.

6 Claims, 2 Drawing Sheets

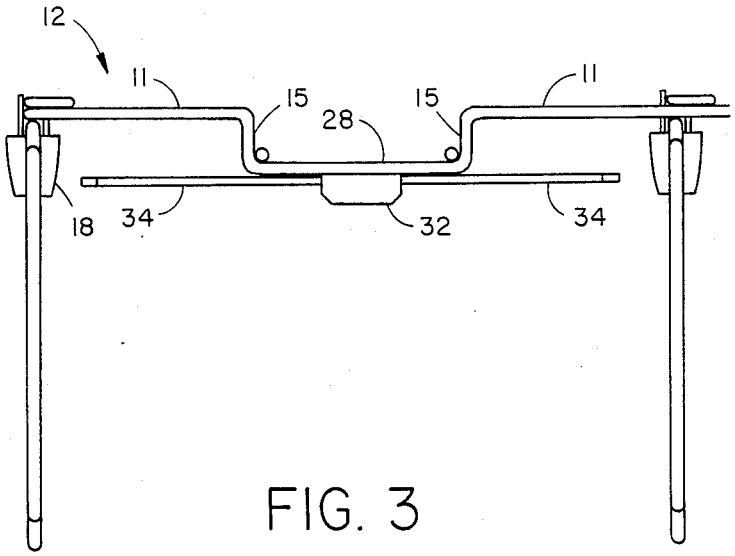
FIG. 3
FIG. 4
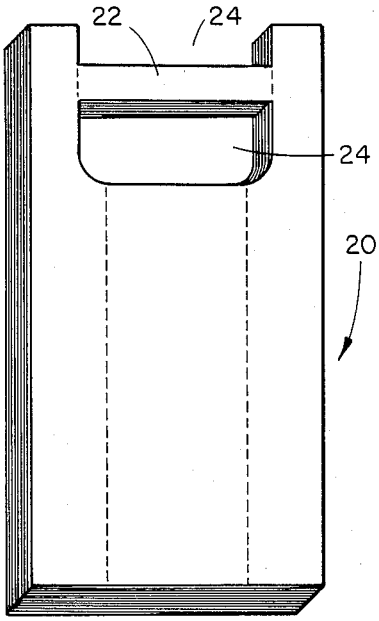
FIG. 5
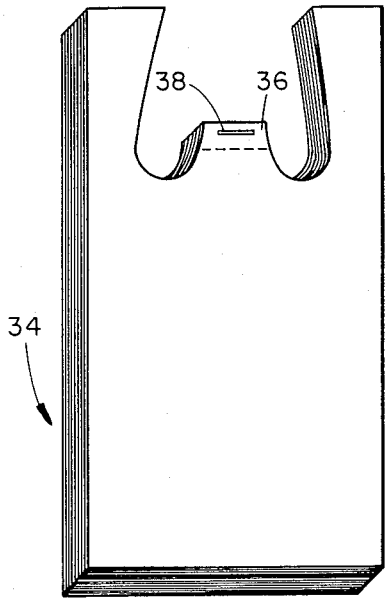

APPARATUS FOR SUSPENDING BAG PACKS OF DIFFERENT GEOMETRY

BACKGROUND OF THE INVENTION

The present invention relates generally to an apparatus for the support of loop handle bag packs of different geometry and the loading of individual bags from said packs. More particularly, the invention pertains to a frame structure adapted to suspend grocery bag packs of different geometry and the dispensing and loading of individual grocery bags from the bag packs in a grocery store environment.

Over the past several years, the use of thermoplastic film grocery sacks has successfully found its way into the supermarket industry. These bags are successful because of their advantages of economy, strength, imperviousness to liquids, ease of carrying, etc. Such bags are employed at the check-out counter of a supermarket in the form of packs of bags wherein a plurality of individual bags are collected together for individual dispensing as needed. Packs of bags are best utilized at the check-out counter with the aid of a rack apparatus designed to suspend the pack and assist in loading of the individual bags. Apparatus of this type are necessary because of the inherent limp nature of the bags which prevent them from standing alone during the process of loading the bags. Bags which now are provided in packs of 100, 150, etc., are quite heavy and require a dispensing and support rack of sturdy construction. In addition, bag packs of different geometry are available and it is now necessary for the supermarkets to be provided with a rack which can conveniently and rapidly suspend bag packs and dispense bags of a different geometry.

Bag packs of two different general geometries can be represented by U.S. Pat. Nos. 4,493,419, to Prader and 4,165,832, to Kuklies et al, the disclosures of which are in their entirety incorporated herein by reference. More details will be given below regarding bag packs typified by these two patents.

It would be a significant advance in the art if the supermarket industry could be provided with a suspension and bag loading structure which would expeditiously accommodate more than one different bag pack geometry. It is a primary object of the present invention to provide such an apparatus.

SUMMARY OF THE INVENTION

The primary object of the invention is satisfied by an apparatus for the support of loop handled bag packs of different geometry and for the loading of individual bags from said packs comprising in combination:

(a) a frame having a front and a rear comprising at least one pair of spaced horizontal members interconnected by spaced vertical members;

(b) the horizontal members include a central length which is spaced from the end lengths of the horizontal member by a pair of spacing lengths interconnecting the central and end lengths, said spacing lengths functioning to accommodate the thicknesses of bag packs suspended by said apparatus;

(c) a first support means carried by said central lengths, said support means being for a first pack of bags of a first general geometry which includes a stack of bags, each bag of which has a front and rear panel closed at the sides and bottom, a bag mouth opening, loop handles as integral extensions of said front and rear panels at the opposite ends of said bag mouth opening and a cross-member at or near the hand-gripping region of said handles interconnecting the same; said first support means comprising two or more spaced vertical posts carried by said central lengths and extending above the uppermost horizontal member and adapted to support said pack of first general geometry from said cross-member thereof;

(d) a second support means carried by said central length, located between said vertical posts and extending above the uppermost horizontal member, said second support means being for a second pack of bags of a second general geometry, said second general geometry includes a stack of bags, each bag of which has a front and rear panel closed at the bottom and sides, a bag mouth opening, loop handles as integral extensions of said front and rear panels at opposite ends of said bag mouth opening and tab extensions from the front and rear panels at the center region of said bag mouth opening, said tab extensions having second support orifice means therein; said second support means comprising means adapted to fit within said orifice means to support said second pack of bags therefrom, said second support means being adapted to support said second pack of bags from at or above the same plane as said first support means;

(e) a horizontal handle holder member affixed to said second support means, said holder being adapted to support all the handles of the bags of a second geometry; and (f) handle arms extending from, and hingedly attached to said frame and extending forwardly of said frame, said arms being adapted to extend and separate the individual loop handles of each bag from one other.

BRIEF DESCRIPTION OF THE DRAWINGS

The foregoing objects, advantages and characterizing features of the inventive apparatus will become clearly apparent from the ensuing detailed description of an illustrative embodiment thereof, taken together with the accompanying drawings wherein like referenced numerals denote like parts throughout the views and in which:

FIG. 3 is a top plan view of the apparatus depicted in FIG. 1; and

FIG. 4 is a front perspective view of a pack of bags of a first geometry and FIG. 5 is a front perspective view of a pack of bags of a second geometry.

DESCRIPTION OF THE PREFERRED EMBODIMENTS

It is to be understood that while the drawings illustrate apparatus for suspending different shape packs of bags, i.e., one or the other bag pack, the invention extends to a plurality, i.e., two or more racks, side by side. As indicated above, the pack of bags can be of a first general geometric configuration or of a second general geometric configuration as hereinafter more particularly described.

Figure 1:
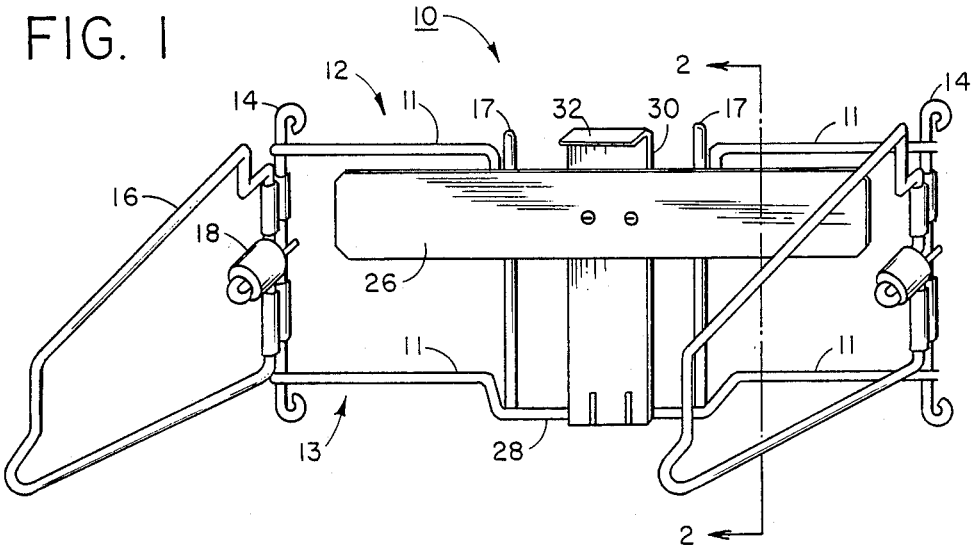
FIG. 1 is a front perspective view of an apparatus of the invention.

Referring now to the drawings, the present invention contemplates the use of an apparatus for suspending grocery bag packs and loading individual handled grocery sacks comprising a frame 10 which is constructed of horizontal members 12 and 13, vertical members 14 and bag handle arms 16. As shown by FIG. 1, the horizontal members 12 and 13 are spaced from each other and interconnected by means of the vertical members 14. As a matter of convenience for the user, the bag handle arms 16 can be flexible or pivotably attached to vertical members 14. A convenient spring mechanism, which forms no part of this invention, is shown at 18 in FIGS. 1, 2 and 3 and more particularly described in my U.S. Pat. No. 4,398,689, the disclosure of which is incorporated herein by reference in its entirety.

Figure 2:
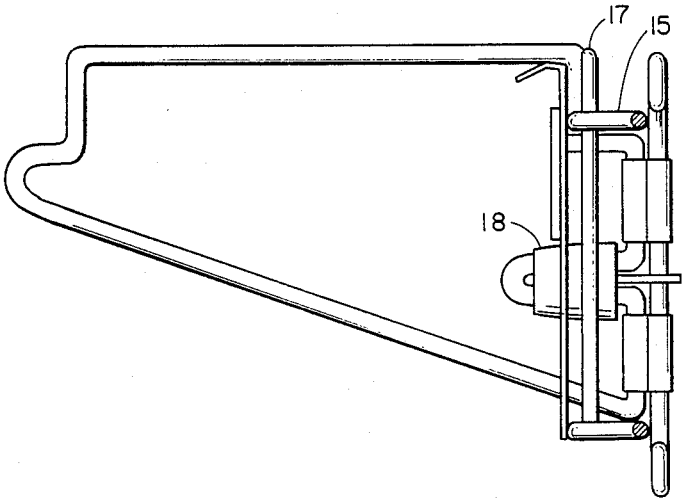
FIG. 2 is a side view in enlarged cross section along lines 2—2 FIG. 1.

Horizontal members 12 and 13 can have different shapes so long as the first support means and second support means (described below) are attached thereto or are a part thereof so as not to interfere with their alternate use. As shown in FIGS. 1, 2 and 3, members 12 and 13 include end lengths 11, and a central length 28 both connected by spacing segments 15. These have a specific function as will be explained below.

The upper and lower horizontal member or members 12 and 13, include a first support means as a part thereof. This first support means, as shown in FIG. 1, consists of a pair of spaced posts 17 carried by central length 28 and which extend above member 12. The front part of the rack is facing the user and the posts 17 are positioned so as to be pointing upwardly.

This first support means is for a first pack of bags of a first general geometry which includes a stack of bags, each bag of which has a front and rear panel closed at the sides and bottom, a bag mouth opening, loop handles as integral extensions of said front and rear panels at opposite ends of said bag mouth opening and a cross-member at or near the hand-gripping regions of said handles interconnecting the same. This bag pack and the individual bags of which it is composed can be of the type described in my U.S. Pat. No. 4,493,419. This first general geometry bag pack 20 is illustrated in FIG. 4 which shows its handle cross-member 22 severably attached to the bag handles. Bags of this first general geometry are formed of a collapsed gusseted tube of thermoplastic film such as polyethylene. The collapsed gusseted tube is sealed and severed along two spaced lines to form what is known as a "pillowcase". A plurality of these "pillowcases" are stacked in registration (e.g. 12×24 inches layflat dimensions) to any convenient number, e.g. 50, 100, 150, etc. Thereafter, near one end of the "pillowcase" one or more square or rectangular regions 24 are removed and the removed portion is returned to be recycled into additional tubular film. As a result of the removal of this material, there is formed a structure which has a pair of double film handles at one end of a bag structure having a bag mouth opening. The double film handles remain interconnected by a bridging member 22 extending from near the hand gripping region of said handles interconnecting the same. This interconnecting member can be at the very top of the handles. During the action of removing the generally rectangular or square region of the "pillowcase", perforation means can perforate the interconnecting or bridging portion of the arrangement so as to accommodate separation of the handles from the bridging member at the time of loading of a bag. A bag pack of this configuration is conveniently supported by placing the bridging portion 22 of the pack in back of post members 17 of FIG. 1. In this way the weight of the bag pack 20 will cause the handle cross-member 22 to be confined in back of the post members 17 holding them securely in place. The handles of the bag pack will drape over the end regions of handle holder 26 at the front of the frame 10, and the remainder of the pack will suspend therefrom. The length of spacing segments 15 must be such as to permit a bag pack of any reasonable number to fit between the wall on which the rack will be mounted and the backs of post members 17.

Attached to horizontal member 12, about centermost in central length segment 28, is a support post 30 which is further provided with a tabular portion 32. The support post 30 and its tabular portion 32 constitute a second support means which is designed to support a pack of bags of second general geometry from at or above the same plane as the first support post members 17. The tabular member 32 is designed to fit within a complementary orifice in a bag pack tab of a bag pack of second general geometry. A pack of bags of the second general geometry is of the type described in U.S. Pat. No. 4,165,832, particularly that illustrated herein in FIG. 5. A pack of bags 34 of this geometry is also made from a collapsed gusseted tube of thermoplastic film such as polyethylene. The collapsed tube, as with the case of the previously described pack, is formed into "pillowcases" which are stacked in registration to include any convenient number. Thereafter, one end of the "pillowcase" pack is removed so as to leave, as integral extensions of the front and rear panels, double film looped handles at opposite ends of a bag mouth opening. This removal is of such a configuration so as to leave removably attached at the bag mouth opening, front and rear bag panel tabs 36 which can be interconnected by thermal welding to form a bag pack. Also during pack formation, the tab members can have a suspension orifice of any suitable shape formed therein. For example, in order to accommodate the structure shown in FIG. 1, the orifice in the bag tabs would be a narrow rectangular orifice corresponding to the shape of the second support tabular means 32, see orifice 38 in the FIG. 5. It is to be understood, however, that member 32 can be one or a plurality of rods or it can be a wire-form tab and the orifice be of a complementary nature.

The member 32 is preferably bent at an angle of from about 30°–120°, preferably 90°, opening towards the user. The angle in this position prevents the user from pulling the bag pack off member 32 by a sharp pull in an upward direction. By wire form is meant a generally arcuate or parabolic shape member or one very similar to the shape of tab 32 but made of wire bends. In operation, a bag pack of the second general geometry, as described, is suspended from its tabs by means of placing the orifice 38 of the tabs about tabular member 32. Thereafter, all of the handles of the bag pack of this second general geometry can be folded over the top of and behind the end regions 34 of handle holder 26. With the bag pack in this suspended attitude and the handles draped over handle holder 26, the first bag of the bag pack facing the user is well positioned to be opened and have the handles of the bag extended over bag handle arms 16 so that the bag can be filled.

Lower horizontal member 13 functions generally to complete the frame and to give rigidity to the structure, while simultaneously providing an anchoring spot for the bottom of posts 17 and support post 30. The shape of lower horizontal member 13 can be a simple arcuate rod or it can be a member having exactly the same shape as upper horizontal member 12.

In operation, the bag pack holder depicted in FIG. 1, is fastened to the end of a supermarket checkout counter by any well known attachment means. Normally a step or a platform is supplied attached to the end of the checkout counter which functions to support the bottom of a 1/6th barrel plastic grocery sack. After the rack is attached, a pack of bags can be loaded and supported on the rack arrangement. It is believed that the defined structure is an excellently functioning bag rack that can support bags of two different general geometry and support them both from approximately the same plane. This feature is important because if tab member 32 extends below horizontal member 12 there would be considerable awkwardness and difficulty involved in loading a bag pack of the second geometry in the rack. After the bag pack is supported on their appropriate means, to load an individual bag, one bag is extended from the stack by grasping the handles thereof and stretching them over the handle holder or handle stretching segment 16. In bags with a cross-member between handles, the cross-member is either removed or severed in the center region thereof. The handle holders then keep the plastic bag in open posture, ready for receiving the grocery items.

From the foregoing, it is apparent that the object of the present invention, that is the provision of a structure which permits the use of bag packs of two different general geometries, has been fully accomplished. Although preferred embodiments of the principles of this invention has been described and illustrated in detail herein, it should be realized that the same are not limited to the particular configuration shown in the drawings, and that modifications thereof are contemplated and can be made without departing from the broad spirit and scope of this invention as defined in the appended claims.

What is claimed is:

1. An apparatus for the support of loop handle bag packs of different geometry and for the loading of individual bags from said packs comprising in combination:

(a) a frame having a front and a rear comprising at least one pair of spaced horizontal members interconnected with spaced vertical members;

(b) the horizontal members include a central length which is spaced from the end lengths of the horizontal member by a pair of spacing lengths interconnecting the central and end lengths, said spacing lengths functioning to accommodate the thicknesses of bag packs suspended by said apparatus;

(c) a first support means carried by said central length, said support means being for a first pack of bags of a first general geometry which includes a stack of bags, each bag of which has a front and rear panel closed at the sides and bottom, a bag mouth opening, loop handles as integral extensions of said front and rear panels at the opposite ends of said bag mouth opening and a cross-member at or near the hand-gripping region of said handles interconnecting the same; said first support means comprising two or more spaced vertical posts carried by said central length and extending above the uppermost horizontal member a sufficient distance to permit the cross-member of said pack of first general geometry to be positioned in back of said posts permitting support of said pack of first general geometry;

(d) a second support means carried by said central length and located between said vertical posts and extending above the uppermost horizontal member, said second support means being for a second pack of bags for a second general geometry, said second general geometry includes a stack of bags, each bag of which has a front and rear panel closed at the bottom and sides, a bag mouth opening, loop handles as integral extensions of said front and rear panels at opposite ends of said bag mouth opening and tab extensions from the front and rear panels at the center region of said bag mouth opening, said tab extensions having second orifice means therein; said second support means comprising means adapted to fit within said orifice means to support said second pack of bags therefrom, said second support means being adapted to support said second pack of bags from at or above the same plane as said first support means;

(e) a horizontal handle holder member affixed to said second support means said holder being adapted to support the handles of the bags of a second geometry; and (f) loop handle arms extending from, and attached to said frame extending forwardly of said frame said arms being adapted to extend and separate the individual loop handles of each bag from one another.

2. The apparatus of claim 1 wherein said handle holder is adapted to be behind the sides, front and rear of said pack of first general geometry and beneath the handles of said pack of bags of second general geometry.

3. The apparatus of claim 2 wherein said spacing lengths are connected to said central and end lengths through about 90° angle bends.

4. The apparatus of claim 3 wherein said handle holder is of a generally rectangular configuration transversely extending in relation to said vertical posts and said second support means and longitudinally extending in relation to said frame.

5. An apparatus according to claim 4 wherein said handle holder is of a flexible material.

6. The apparatus according to claim 5 wherein said frame and handle support arms are of a wire form material.

* * * * *